US009561576B2

(12) United States Patent
Lancaster-Larocque et al.

(10) Patent No.: US 9,561,576 B2
(45) Date of Patent: Feb. 7, 2017

(54) CYLINDRICAL LAPPING

(71) Applicant: Apple Inc., Cupertino, CA (US)

(72) Inventors: Simon Regis Louis Lancaster-Larocque, Gloucester (CA); Collin D. Chan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 129 days.

(21) Appl. No.: 14/185,074

(22) Filed: Feb. 20, 2014

(65) Prior Publication Data

US 2014/0364038 A1 Dec. 11, 2014

Related U.S. Application Data

(60) Provisional application No. 61/832,555, filed on Jun. 7, 2013.

(51) Int. Cl.

| | |
|---|---|
| ***B24B 37/02*** | (2012.01) |
| ***B24B 37/005*** | (2012.01) |
| ***B24B 5/04*** | (2006.01) |

(52) U.S. Cl.

CPC ..... *B24B 37/02* (2013.01); *B24B 5/042* (2013.01); *B24B 5/045* (2013.01); *B24B 5/047* (2013.01); *B24B 37/005* (2013.01)

(58) Field of Classification Search

CPC ..... B24B 5/04; B24B 5/042; B24B 5/045; B24B 5/047; B24B 37/02; B24B 37/025; B24B 37/105

See application file for complete search history.

(56) References Cited

U.S. PATENT DOCUMENTS

| | | | | | |
|---|---|---|---|---|---|
| 240,966 | A * | 5/1881 | Chappell | A21C 7/01 | 425/332 |
| 1,055,187 | A * | 3/1913 | Kirner | B24B 3/54 | 451/267 |
| 1,516,749 | A * | 11/1924 | Moore | B24B 11/06 | 451/268 |
| 1,605,161 | A * | 11/1926 | Blood | B24B 37/022 | 451/267 |
| 1,610,984 | A * | 12/1926 | Keuren | B24B 37/022 | 451/267 |
| 2,026,429 | A * | 12/1935 | North | B24B 37/02 | 451/273 |
| 2,275,061 | A * | 3/1942 | Indge | B24B 37/08 | 451/268 |
| 2,610,450 | A * | 9/1952 | White | B24B 37/02 | 451/283 |
| 2,992,446 | A * | 7/1961 | James | A47L 25/00 | 15/97.1 |
| 3,654,655 | A * | 4/1972 | Mitnick | A63B 47/04 | 15/21.2 |

(Continued)

*Primary Examiner* — Timothy V Eley

(74) *Attorney, Agent, or Firm* — Downey Brand LLP

(57) ABSTRACT

The described embodiments relate generally to lapping operations and related systems and apparatuses. Various embodiments of lapping tables are described for applying a lapping operation to a non-planar surface of a workpiece. For example, methods and apparatus are described which allow a lapping operation to be applied to a curved outer surface portion of a cylindrical workpiece. Lapping of non-planar outer surfaces of workpieces is conducted by rotating the workpieces during the lapping operations.

20 Claims, 8 Drawing Sheets

(56) References Cited

U.S. PATENT DOCUMENTS

| | | | | |
|---|---|---|---|---|
| 3,863,397 | A * | 2/1975 | Reitz | B24B 5/36 451/283 |
| 3,999,330 | A * | 12/1976 | Brany | B24B 11/02 451/284 |
| 6,923,713 | B2 | 8/2005 | Yoshimi et al. | |
| 7,553,115 | B2 | 6/2009 | McGlasson et al. | |
| 7,585,203 | B1 * | 9/2009 | Shim | B24B 11/04 451/283 |
| 8,177,605 | B2 * | 5/2012 | Shim | A63B 45/00 451/159 |
| 2015/0306727 | A1 * | 10/2015 | Otsuki | B24B 37/30 451/59 |

* cited by examiner

CYLINDRICAL LAPPING

CROSS-REFERENCE TO RELATED APPLICATIONS

This application claims the benefit priority under 35 U.S.C §119(e) to U.S. Provisional Application No. 61/832,555, filed on Jun. 7, 2013, the disclosure of which is incorporated herein by reference in its entirety.

FIELD

The described embodiments relate generally to lapping. In particular a method for applying lapping to a three-dimensional object (e.g., a cylindrical object) is disclosed.

BACKGROUND

Components employed to form various devices such as computing devices often undergo numerous manufacturing operations during the production thereof. Additive manufacturing processes add material to form a component. By way of example, injection molding may be employed to form a component. Conversely, subtractive manufacturing processes remove material from a workpiece or substrate to form a component. For example, material may be machined from a substrate to form the component. In some embodiments both additive and subtractive processes may be employed to form a component, depending on the particular desired final configuration of the component.

Computer numerical control (CNC) machining is one example of a type of subtractive manufacturing process commonly employed to form components. CNC machining typically employs a robotic assembly and a controller. The robotic assembly may include a rotating spindle to which a milling cutter, or alternate embodiment of cutter, is coupled. The milling cutter includes cutting edges that remove material from a workpiece to form a component defining a desired shape and dimensions. In this regard, the controller directs the robotic assembly to move the milling cutter along a machining path that forms the component. However, CNC machining and various other manufacturing processes may not provide a desired surface finish.

In this regard, the workpiece may undergo finishing operations such as lapping operations in order to produce a desired surface finish. Lapping operations generally employ a lapping table to finish flat surfaces of a workpiece. Lapping processes can be applied when a mirrored or high gloss finish is desired for a given workpiece. In this regard, lapping tables typically include a substantially planar abrasive disc capable of producing particularly smooth surface finishes. However, in general, lapping operations are not easily adapted to lapping non-planar surfaces. For example, cylindrical surfaces can be finished by other processes such as abrasive tape finishing or centerless grinding. Unfortunately, these known processes are not well suited for providing a mirrored or at least high gloss finish across a cylindrical surface.

Therefore, what is desired is an efficient and reliable way to apply a lapping operation to a non-planar surface.

SUMMARY

This paper describes various embodiments that relate to applying a lapping operation to a non-planar surface.

A method and apparatus for performing a lapping operation is disclosed. The method may include providing a lapping table comprising an abrasive disc defining a substantially planar abrasive surface. Further, the method may include rotating the abrasive disc about a first axis extending substantially perpendicularly to the substantially planar abrasive surface. Additionally, the method may include rotating a workpiece about a second axis such that a three-dimensional outer surface of the workpiece is in contact with the substantially planar abrasive surface of the abrasive disc, the second axis being non-parallel to the first axis. In this regard, outer, non-planar surfaces of objects may be subjected to lapping operations. For example, the workpiece may be a cylindrical workpiece. The method may also include rotating the workpiece about a third axis, the third axis extending substantially parallel to the first axis, to avoid issues with respect to portions of the workpiece being subjected to more abrasion. Each of the steps of the method may be performed concurrently.

Other aspects and advantages of the present disclosure will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Figure 1:
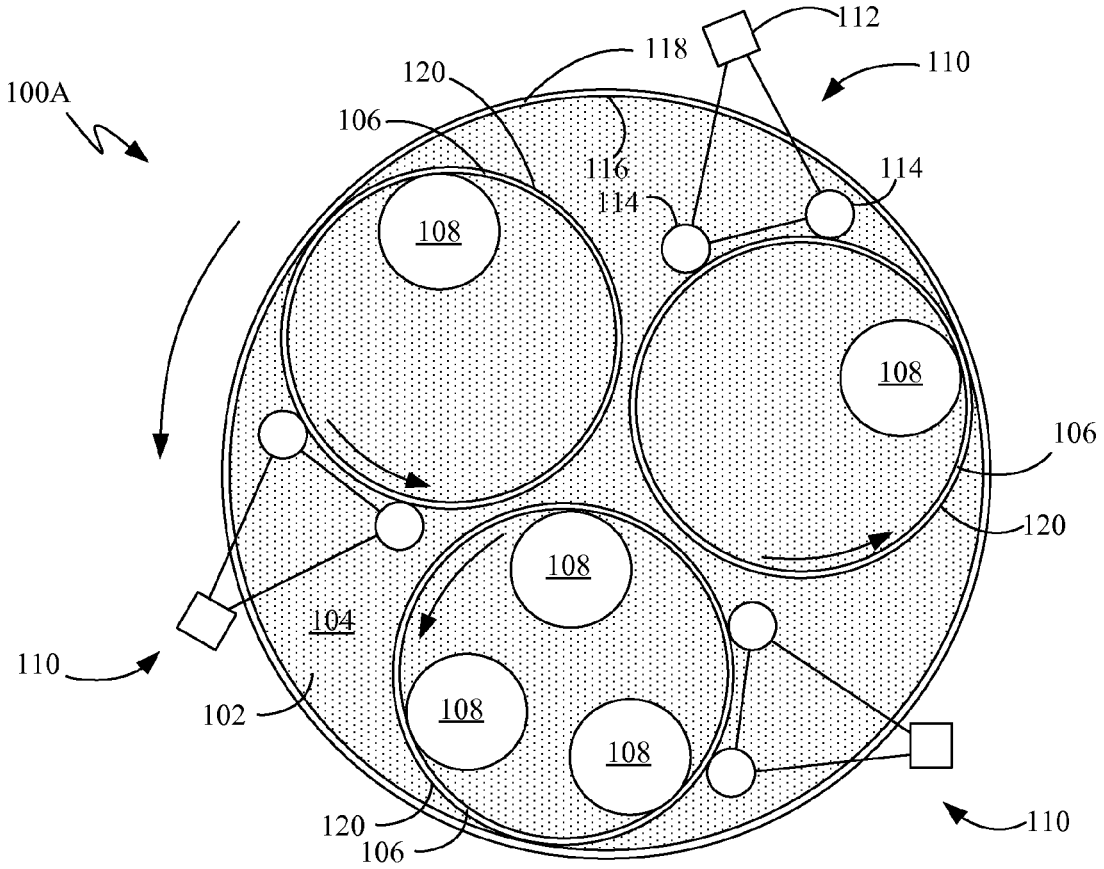
FIG. 1 illustrates a top view of a lapping table configured to perform a lapping operation on a workpiece defining a planar outer surface and including conditioning rings driven by a lip of an abrasive disc according to an example embodiment of the present disclosure.

FIG. 1 illustrates a top view of an embodiment of a lapping table 100A. The lapping table 100A may include an abrasive disc 102. The abrasive disc 102 may define a substantially planar abrasive surface 104. The abrasive disc 102 can be coupled to a rotational mechanism (e.g., a motor) configured to rotate the abrasive disc at various speeds about an axis (e.g., a central axis of the abrasive disc) extending substantially perpendicularly to the substantially planar abrasive surface 104. The speed at which abrasive disc 102 rotates can be selected based on the type of surface finish that is desired from the lapping operation, amongst other factors.

The lapping table 100A may additionally include one or more conditioning rings 106. The conditioning rings 106 may include one or more attachment mechanisms for coupling one or more workpieces 108 (e.g., a component undergoing finishing) along an inside surface of the conditioning ring such that the workpieces are retained therein. In this regard, a center portion of the conditioning rings 106 may be hollow as illustrated, and the attachment mechanisms may engage the workpieces 108 such that workpieces are held therein. Alternatively, the conditioning rings 106 may comprise discs with cutouts therethrough configured to receive the workpieces therein.

In some embodiments the weight of the workpieces 108 may be great enough to produce sufficient force between the workpieces and the substantially planar surface 104 of the abrasive disc 102 to finish the workpieces to a desired extent. However, in other embodiments additional force may be applied to the workpieces 108 against the substantially planar surface 104 of the abrasive disc 102 to facilitate finishing the workpieces. For example, the workpieces 108 may be coupled to the conditioning rings 106 such that the weight of the conditioning rings presses the workpieces against the substantially planar abrasive surface 104 of the abrasive disc 102. In another embodiment a pressure plate may press the workpieces against the substantially planar abrasive surface of the abrasive disc.

Regardless of the particular embodiment of the conditioning rings 106, the workpieces 108 may be in contact with the substantially planar abrasive surface 104 of the abrasive disc 102. However, the conditioning rings 106 may prevent the workpieces 108 from rotating with the abrasive disc 102 such that relative movement therebetween occurs in order to abrade a surface of the workpieces 108 in contact with the substantially planar abrasive surface 104 of the abrasive disc 102. In this regard, linkages or support members 110 may be employed to hold the conditioning rings 106 in place such that relative movement between the conditioning rings and the abrasive disc 102. For example, the support members 110 may include an outer attachment mechanism 112 that is stationary. Further, the support members 110 may include inner engagement mechanisms 114 that engage the conditioning rings 106 to prevent the conditioning rings from rotating with the abrasive disc 102.

However, each of the conditioning rings 106 may rotate during operation of lapping table 100A. In this regard, each of the conditioning rings 106 may rotate about a respective axis extending substantially parallel to the axis about which the abrasive disc 102 rotates. More particularly, the conditioning rings 106 may each rotate about a respective central axis thereof. The rotational speed of each of conditioning rings 106 can be configured as a function of a rotational speed of the abrasive disc 102. For example, as illustrated in FIG. 1, in some embodiments an inner surface 116 of an outer lip 118 of the abrasive disc 102 can frictionally engage an outer periphery 120 of each of the conditioning rings 106 such that the conditioning rings are rotationally coupled therewith. Thereby, the abrasive disc 102 and the conditioning rings 106 may be mechanically coupled to one another such that a rotational speed of each conditioning ring is defined by a rotational speed of the outer lip 118 of the abrasive disc. Further, the support members 110 may allow rotation of each of the conditioning rings 106 by employing rollers as the inner engagement mechanisms 114.

Figure 2:
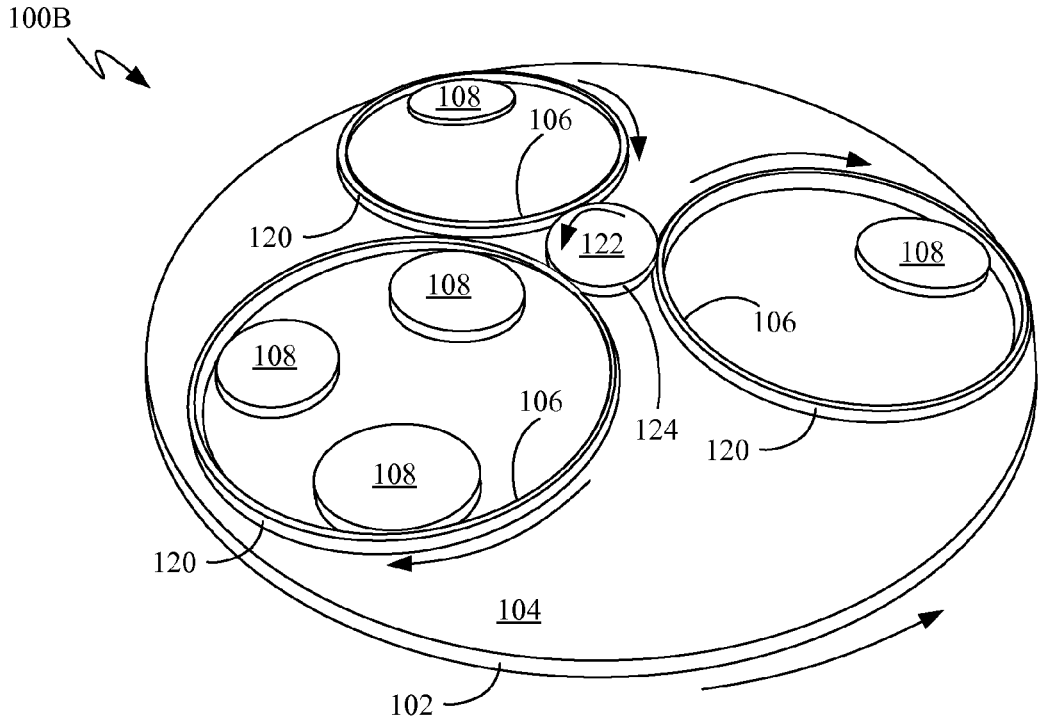
FIG. 2 illustrates a perspective view of an alternate embodiment of a lapping table configured to perform a lapping operation on a workpiece defining a planar outer surface and including conditioning rings driven by a hub according to an example embodiment of the present disclosure.

FIG. 2 illustrates a perspective view of an alternate embodiment of a lapping table 100B. The lapping table 100B of FIG. 2 may be substantially similar to the lapping table 100A of FIG. 1 in a number of respects. In this regard, the lapping table 100B may include the abrasive disc 102 defining the substantially planar abrasive surface 104, one or more conditioning rings 106 configured to support workpieces 108 thereon. Note that support members (e.g., the above-described support members 110) may be employed in the lapping table 100B to hold the conditioning rings 106 in place while allowing for rotation thereof. However, for clarity purposes, the support members are not shown in FIG. 2.

However, FIG. 2 illustrates an alternative configuration for rotating the conditioning rings 106. In this regard, as illustrated, the conditioning rings 106 can be engaged by a centrally positioned hub 122. More particularly, an outer edge 124 of the hub 122 may engage the outer periphery 120 of each of the conditioning rings 106 such that the conditioning rings rotate about respective central axes thereof. In some embodiments the hub 122 may comprise a geared hub, which may be rotationally coupled to the abrasive disc 102 such that rotation of the abrasive disc 102 causes rotation of the hub 122. Further, in some embodiments the hub 122 may be rotationally decoupled from the abrasive disc 102 and configured to rotate independently of the abrasive disc. Thereby, the conditioning rings 106 may be rotated at a number of rotational speeds, independent of a speed of the abrasive disc 102.

Note that the lapping tables 100A, 100B described above are configured such that the conditioning rings 106 are actively rotated. More particularly, the outer periphery 120 of each of the conditioning rings 106 is contacted by either the outer lip 118 of the abrasive disc 102 (see, FIG. 1) or a hub 122 (see, e.g. FIG. 2) to impart rotational motion to the conditioning rings. However, the conditioning rings 106 may be rotated in various other manners within the scope of the present disclosure.

For example in another embodiment the conditioning rings 106 may be configured to passively rotate as a result of rotation of the abrasive disc 102. In this regard, as the abrasive disc 102 passes underneath the conditioning rings 106, portions of the conditioning rings farthest from the rotational axis of the abrasive disc are in contact with portions of the abrasive disc traveling at a greater speed than a speed of the abrasive disc in contact with portions of the conditioning rings closest to the center of the abrasive disc. Thus, by employing rollers at the inner engagement mechanisms 114 of the support members 110, the conditioning rings 106 may tend to rotate as a result of the speed differential applied to inner and outer portions of the conditioning rings (relative to the rotational axis of the abrasive disc 102) by the abrasive disc.

The lapping tables 100A, 100B described above and illustrated in FIGS. 1 and 2 are generally configured such that the abrasive disc 102 spins underneath the conditioning rings 106, while the conditioning rings spin in place about respective central axes thereof. The conditioning rings 106 can be kept in place by support members (e.g., the support members 110). In this way, a bottom surface of each of the workpieces 108 can be exposed to varying portions of the substantially planar abrasive surface 104 of the abrasive disc 102, thereby preventing any inconsistencies in the substantially planar abrasive surface of the abrasive disc from affecting a finish applied to the workpieces 108. As can be readily appreciated the functionality of the above-described lapping tables 100A, 100B may be narrowly limited to lapping one substantially flat surface of a workpiece 108 in any given finishing operation.

Figure 3:
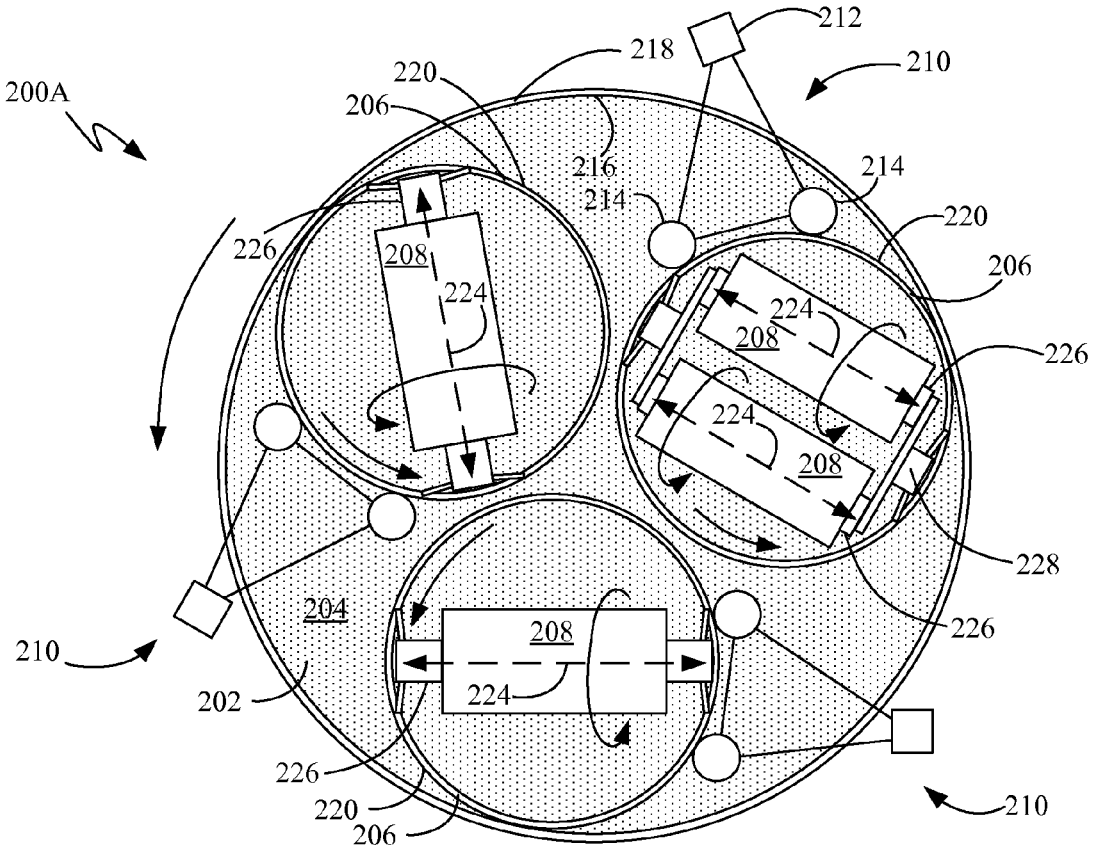
FIG. 3 illustrates a top view of an alternate embodiment of a lapping table configured to perform a lapping operation on a workpiece defining a three-dimensional outer surface and including conditioning rings driven by a lip of an abrasive disc according to an example embodiment of the present disclosure.

FIG. 3 shows a top view of an alternate embodiment of a lapping table 200A. The lapping table 200A of FIG. 3 may be substantially similar to the previously described lapping table 100A illustrated in FIG. 1 in a number of respects. In this regard, the lapping table 200A may include an abrasive disc 202 defining a substantially planar abrasive surface 204, one or more conditioning rings 206 configured to support workpieces 208 thereon. Support member 210 may prevent the conditioning rings 206 from rotating with the abrasive disc 202. The support members 210 may include an outer attachment mechanism 212 that is stationary and one or more inner engagement mechanisms 214 (e.g., rollers) that engage the conditioning rings 206. An inner surface 216 of an outer lip 218 of the abrasive disc 202 can frictionally engage an outer periphery 220 of each of the conditioning rings 206 such that the conditioning rings are rotationally coupled therewith and rotate about respective center axes thereof when the abrasive disc rotates.

Thus, as described above, the abrasive disc 202 can be coupled to a rotational mechanism (e.g., a motor) configured to rotate the abrasive disc at various speeds about an axis (e.g., a central axis of the abrasive disc) extending substantially perpendicularly to the substantially planar abrasive surface 204. Further, a rotational mechanism (e.g., the conditioning rings) may be employed to rotate the workpieces 208 about axes extending substantially parallel to the axis about which the abrasive disc 202 rotates. For example, each of the conditioning rings 206 may rotate about a respective central axis thereof to rotate the workpieces 208 coupled thereto.

However, the lapping table 200A illustrated in FIG. 3 may differ from the previously-described lapping table 100A of FIG. 1 in that the lapping table 200A may be configured to apply a lapping operation to a three-dimensional surface of a workpiece, rather than two-dimensional flat surface. Thus, by way of example, the lapping table 200A may perform lapping operations on one or more cylindrical workpieces 208, as illustrated. Note that although the lapping tables described hereinafter are generally referenced as being configured to perform lapping operations on cylinders, the lapping tables may be employed to perform lapping operations on workpieces defining various other shapes, such as a cone shape, in accordance with embodiments of the present disclosure.

In order to properly finish the entirety of the outer curved surface of the cylindrical workpieces 208, each of the cylindrical workpieces may be respectively rotated about an axis such that a three-dimensional outer surface of each workpiece is in contact with the substantially planar abrasive surface 204 of the abrasive disc 202. In this regard, the axis about which the workpieces are rotated may be non-parallel to the axis about which the abrasive disc 202 rotates. For example, as illustrated, the cylindrical workpieces 208 may be rotated about a central axis 224 thereof. In order to rotate the cylindrical workpieces 208 about the central axes 224 thereof, the lapping table 200A may further comprise a rotational mechanism 226 rotationally coupled to each of the cylindrical workpieces 208. For example, as illustrated, each rotational mechanism 226 may couple to opposing ends of, or extend through, one of the cylindrical workpieces 208. Further, each rotational mechanism may be affixed to one of the conditioning rings 206. Thus, for example, each rotational mechanism 226 may be affixed to one of the conditioning rings 206 at opposing ends of the cylindrical workpieces 208.

Each conditioning ring 208 may receive one or more of the cylindrical workpieces 208. For example, in the illustrated embodiment two of the conditioning rings 206 include one cylindrical workpiece 208 therein, whereas a third conditioning ring includes two cylindrical workpieces therein. In this regard, a bracket 228 may facilitate holding multiple cylindrical workpieces 208 in a conditioning ring 206. Note that various other numbers of cylindrical workpieces may be received in the conditioning rings in other embodiments without departing from the scope of the present disclosure.

The rotational mechanisms 226 may include a rotary motor or other drive mechanism configured to rotate the cylindrical workpieces 208 about the about the respective central axes 224 thereof, as depicted in FIG. 3. In this way, the abrasive disc 202 can be utilized to apply a lapping operation around the entirety of the curved exterior surface of the cylindrical workpieces 208. It should be noted that this operation can also be applied to workpieces having other non-planar geometries. This can be particularly applicable to a workpiece having a partially cylindrical surface, or to a workpiece having a substantially symmetric cross-section.

Figure 4:
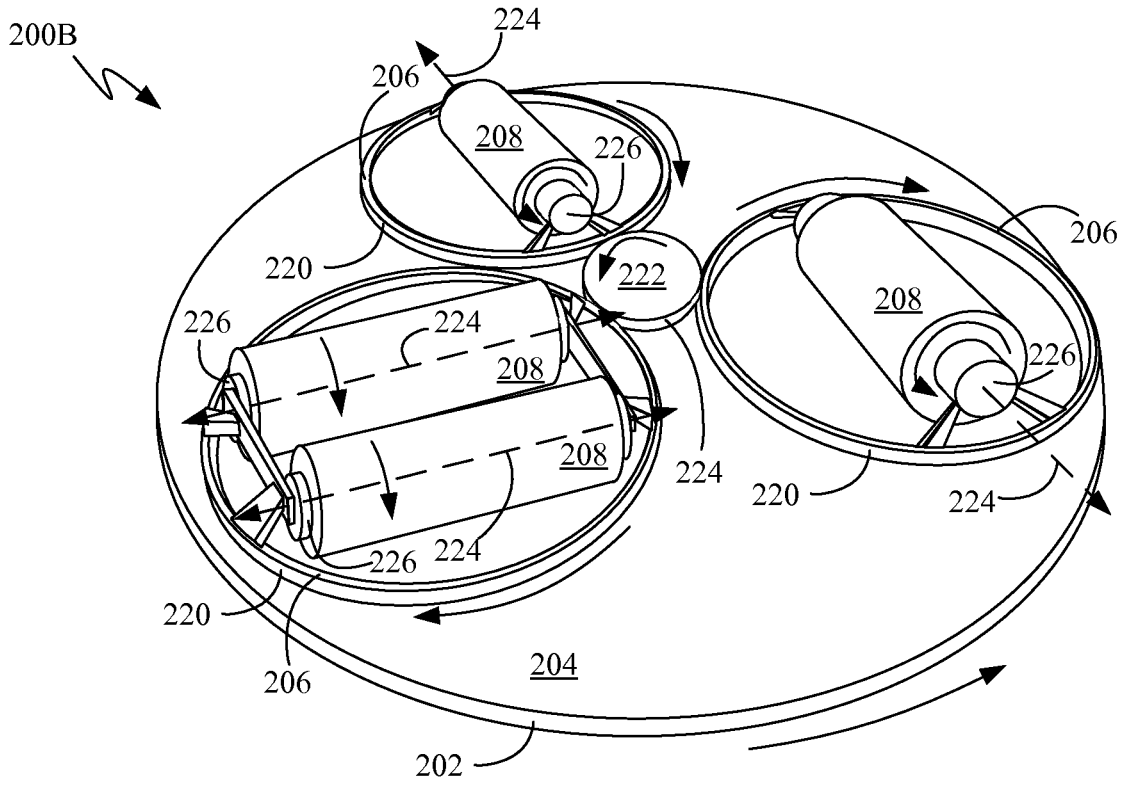
FIG. 4 illustrates a perspective view of an alternate embodiment of a lapping table configured to perform a lapping operation on a workpiece defining a three-dimensional outer surface and including conditioning rings driven by a hub according to an example embodiment of the present disclosure.

FIG. 4 illustrates a perspective view of an alternate embodiment of a lapping table 200B. The lapping table 200B of FIG. 4 may be substantially similar to the lapping table 200A of FIG. 3 in a number of respects. In this regard, the lapping table 200B may include the abrasive disc 202 defining the substantially planar abrasive surface 204, and one or more conditioning rings 206. The lapping table 200B may further comprise the rotational mechanism 226 coupled to the cylindrical rings 206 and configured to rotate each of the cylindrical workpieces 208 about a respective central axis 224 of each cylindrical workpiece. Further, the bracket 228 may be configured to facilitate receipt of multiple cylindrical workpieces 208 in one of the conditioning rings 206. Note that support members (e.g., the above-described support members 210) may be employed in the lapping table 200B to hold the conditioning rings 206 in place while allowing for rotation thereof. However, for clarity purposes, the support members are not shown in FIG. 4.

However, FIG. 4 illustrates an alternative configuration for rotating the conditioning rings 206. In this regard, as illustrated, the conditioning rings 206 can be engaged by a centrally positioned hub 222. More particularly, an outer edge 224 of the hub 222 may engage the outer periphery 220 of each of the conditioning rings 206 such that the conditioning rings rotate about respective central axes thereof. In some embodiments the hub 222 may comprise a geared hub, which may be rotationally coupled to the abrasive disc 202 such that rotation of the abrasive disc 202 causes rotation of the hub 222. Further, in some embodiments the hub 222 may be rotationally decoupled from the abrasive disc 202 and configured to rotate independently of the abrasive disc. Thereby, the conditioning rings 206 may be rotated at a number of rotational speeds, independent of a speed of the abrasive disc 202.

Note that the lapping tables 200A, 200B described above are configured such that the conditioning rings 206 are actively rotated. More particularly, the outer periphery 220 of each of the conditioning rings 206 is contacted by either the outer lip 218 of the abrasive disc 202 (see, FIG. 3) or a hub 222 (see, e.g. FIG. 4) to impart rotational motion to the conditioning rings. However, the conditioning rings 206 may be rotated in various other manners within the scope of the present disclosure.

For example in another embodiment the conditioning rings 206 may be configured to passively rotate as a result of rotation of the abrasive disc 202. In this regard, as the abrasive disc 202 passes underneath the conditioning rings 206, portions of the conditioning rings farthest from the rotational axis of the abrasive disc are in contact with portions of the abrasive disc traveling at a greater speed than a speed of the abrasive disc in contact with portions of the conditioning rings closest to the center of the abrasive disc. Thus, by employing rollers at the inner engagement mechanisms 214 of the support members 210, the conditioning rings 206 may tend to rotate as a result of the speed differential applied to inner and outer portions of the conditioning rings (relative to the rotational axis of the abrasive disc 202) by the abrasive disc.

In the embodiments of the lapping tables 200A, 200B illustrated in FIGS. 3, and 4, the workpieces 208 may be forced against the substantially planar abrasive surface 204 of the abrasive disc 202 by the weight of the workpieces. Further, the weight of the conditioning rings 206, the rotational mechanisms 226, and/or the bracket 228 may be applied to the workpieces 208 to force the workpieces against the substantially planar abrasive surface 204 of the abrasive disc 202. Accordingly, the additional force applied to the workpieces 208 against the substantially planar surface 204 of the abrasive disc 202 may facilitate finishing the workpieces.

Figure 5:
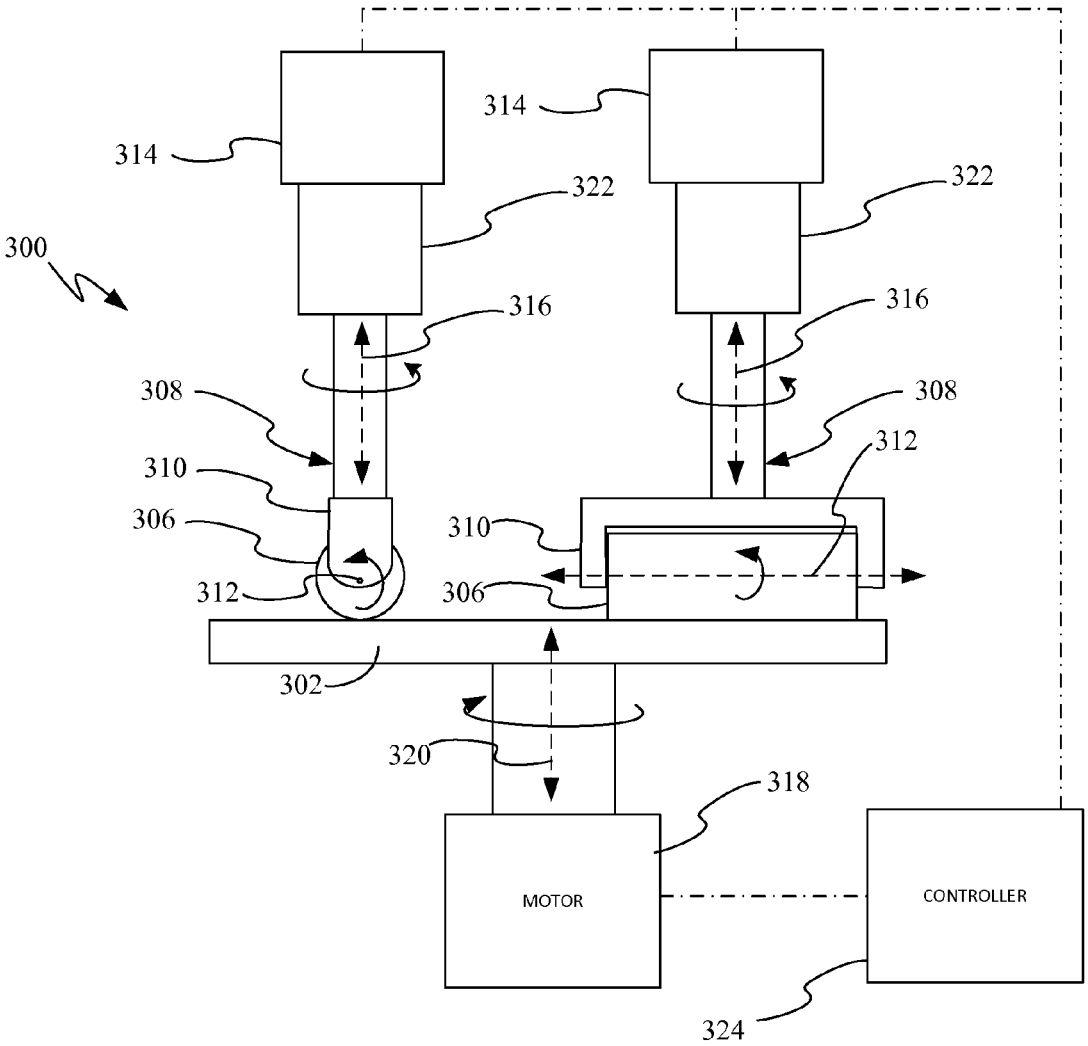
FIG. 5 illustrates a side view of an alternate embodiment of a lapping table configured to perform a lapping operation on a workpiece defining a three-dimensional outer surface and including pressure applicators according to an example embodiment of the present disclosure.
Figure 6:
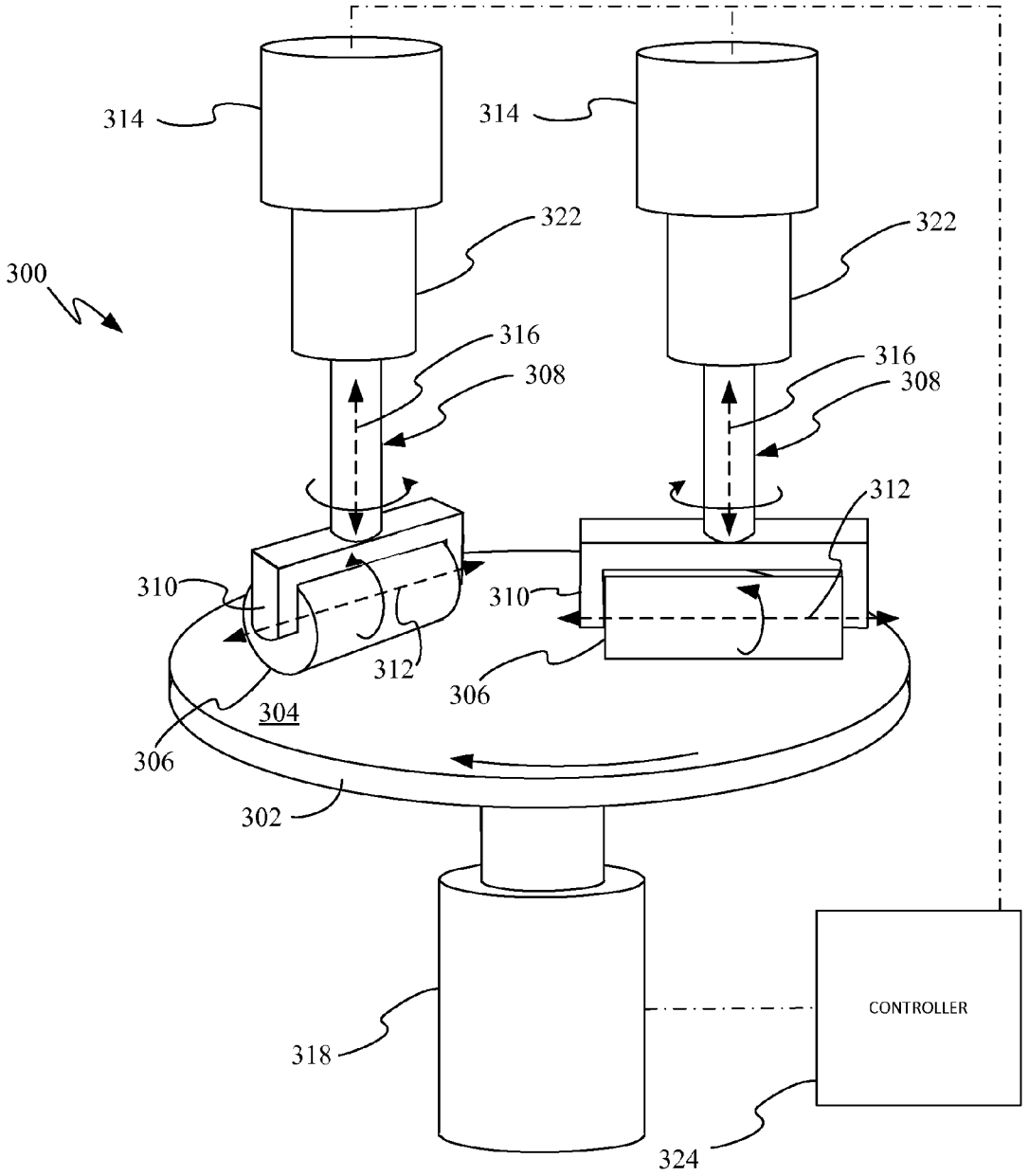
FIG. 6 illustrates a perspective view of the lapping table of FIG. 5 according to an example embodiment of the present disclosure.

However, in other embodiments it may be preferable to actively press the workpieces 208 against the substantially planar surface 204 of the abrasive disc 202 or otherwise control the pressure applied by the cylindrical workpieces 208 against the abrasive disc. In this regard, FIGS. 5 and 6 respectively illustrate side and perspective views of a lapping table 300 according to an additional embodiment of the present disclosure. The lapping table 300 may include an abrasive disc 302 defining a substantially planar abrasive surface 304, which may be similar to the abrasive discs described above and configured to finish cylindrical workpieces 306.

In this embodiment one or more pressure applicators 308 may be configured to respectively engage one or more of the cylindrical workpieces 306. The pressure applicators 308 may be configured to engage end surfaces of the cylindrical workpieces 306 to hold the cylindrical workpieces in a desired position. Thus, as illustrated, the pressure applicators 308 may hold the cylindrical workpieces 306 such that curved outer surfaces thereof are in contact with the substantially planar abrasive surface 304 of the abrasive disc 302

As depicted, the pressure applicators 308 may include a rotational mechanism 310 (e.g. a motor) configured to rotate each of the cylindrical workpieces 306 about a central axis 312 thereof. Accordingly, the entirety of the curved outer surface of the cylindrical workpieces 306 may undergo the lapping operation. The pressure applicators 308 may also include a rotational mechanism 314 (e.g., a motor) configured to spin about an axis 316 substantially normal to the substantially planar abrasive surface 304 of the abrasive disc 302. Rotation about the axis 316 substantially perpendicular to the substantially planar abrasive surface 304 of the abrasive disc 302 may be configured to function in the same manner as rotation of the above-described conditioning rings. More particularly, rotation about the axis 316 may be configured to ensure that finishing of the cylindrical workpieces 306 is conducted evenly. In this regard, without rotation of the workpieces 306 about the axis 316, portions of the workpiece closer to an outer edge of the abrasive disc 302 may undergo a greater degree of finishing than portions of the abrasive disc closer to rotational center of the abrasive disc.

Thus, as described above, the lapping table 300 may perform lapping operations in a manner similar to the manner described above with respect to the lapping tables 200A, 200B illustrated in FIGS. 3 and 4. In this regard, the abrasive disc 302 can be coupled to a rotational mechanism 318 (e.g., a motor) configured to rotate the abrasive disc at various speeds about an axis (e.g., a central axis 320 of the abrasive disc) extending substantially perpendicularly to the substantially planar abrasive surface 304. Further, the rotational mechanism 314 may be employed to rotate the workpieces 306 about axes 316 extending substantially parallel to the axis 320 about which the abrasive disc 302 rotates. Additionally, In order to properly finish the entirety of the outer curved surface of the cylindrical workpieces 306, each of the cylindrical workpieces may be respectively rotated by a rotational mechanism 310 about an axis 312 such that a three-dimensional outer surface of each workpiece is in contact with the substantially planar abrasive surface 304 of the abrasive disc 302. In this regard, the axis 312 about which the workpieces 306 are rotated may be non-parallel to the axis 320 about which the abrasive disc 302 rotates.

However, the lapping table 300 may provide additional functionality. In this regard, the pressure applicators 308 may be configured to apply pressure to the cylindrical workpieces 306 such that the workpieces are forced into contact with the substantially planar abrasive surface 304 of the abrasive disc 302. Accordingly, by applying pressure to the cylindrical workpieces 306 in this manner, finishing thereof may be facilitated. Further, the pressure applicators 308 may be configured to apply a variable amount of pressure between cylindrical workpieces 306 and the substantially planar abrasive surface 304 of the abrasive disc 302. In this regard, by way of example, the pressure applicators 308 may include actuators 322 (e.g., hydraulic or pneumatic actuators) configured to press the cylindrical workpieces 306 against the substantially planar abrasive surface 304 of the abrasive disc 302 with a selectable degree of pressure.

A controller 324 may be configured to control each of the parameters of the lapping table 300. In this regard, the controller 324 may be in communication with the pressure applicators 308 to control the amount of pressure applied to the cylindrical workpieces 306 by the actuators 322 and the rotational speed and direction about the axes 312, 316 as caused by the rotational mechanisms 310, 314. Further, the controller 324 may be communication with the rotational mechanism 318 configured to rotate the abrasive disc 302 control the speed and/or direction of rotation thereof. Accordingly, the controller 324 may control various finishing parameters during a lapping operation to produce a desired surface finish on the cylindrical workpieces 306.

Note that each of the embodiments of lapping tables described herein may include a controller configured to control lapping operations. In this regard, a controller substantially similar to the controller 324 illustrated in FIGS. 5 and 6 may be employed in each of the embodiments of lapping tables. In this regard, the controller may control each of the above described rotational movements and/or control of pressure applied to workpieces against the substantially planar abrasive surface of an abrasive disc.

Further, note that each of the rotational motions disclosed herein may be controlled (e.g., with the controller) to define desired rotational speeds. In this regard, in some embodiments the rotational speeds may be independently controlled. For example, in embodiments of the disclosure discussed above, an abrasive disc may be rotated about a first axis extending substantially perpendicularly to a substantially planar abrasive surface. Further, a workpiece may be rotated about a second axis that is non-parallel to the first axis (e.g., perpendicular thereto). Additionally, the workpiece may be rotated about a third axis, which may be substantially parallel to the first axis. More particularly, the controller can be configured to rotate the workpiece about the third axis in a first direction or a second direction opposite the first direction. In some embodiments the controller can be configured to change a direction and/or speed of rotation of the workpiece during a machining operation. In other embodiments, the workpiece can be configured to rotate freely about the third axis. Accordingly, the rotational speed of each of these rotational movements may be controlled (e.g., independently controlled) to define a desired surface finish on the workpiece and/or meet other desirable manufacturing parameters.

Figure 7:
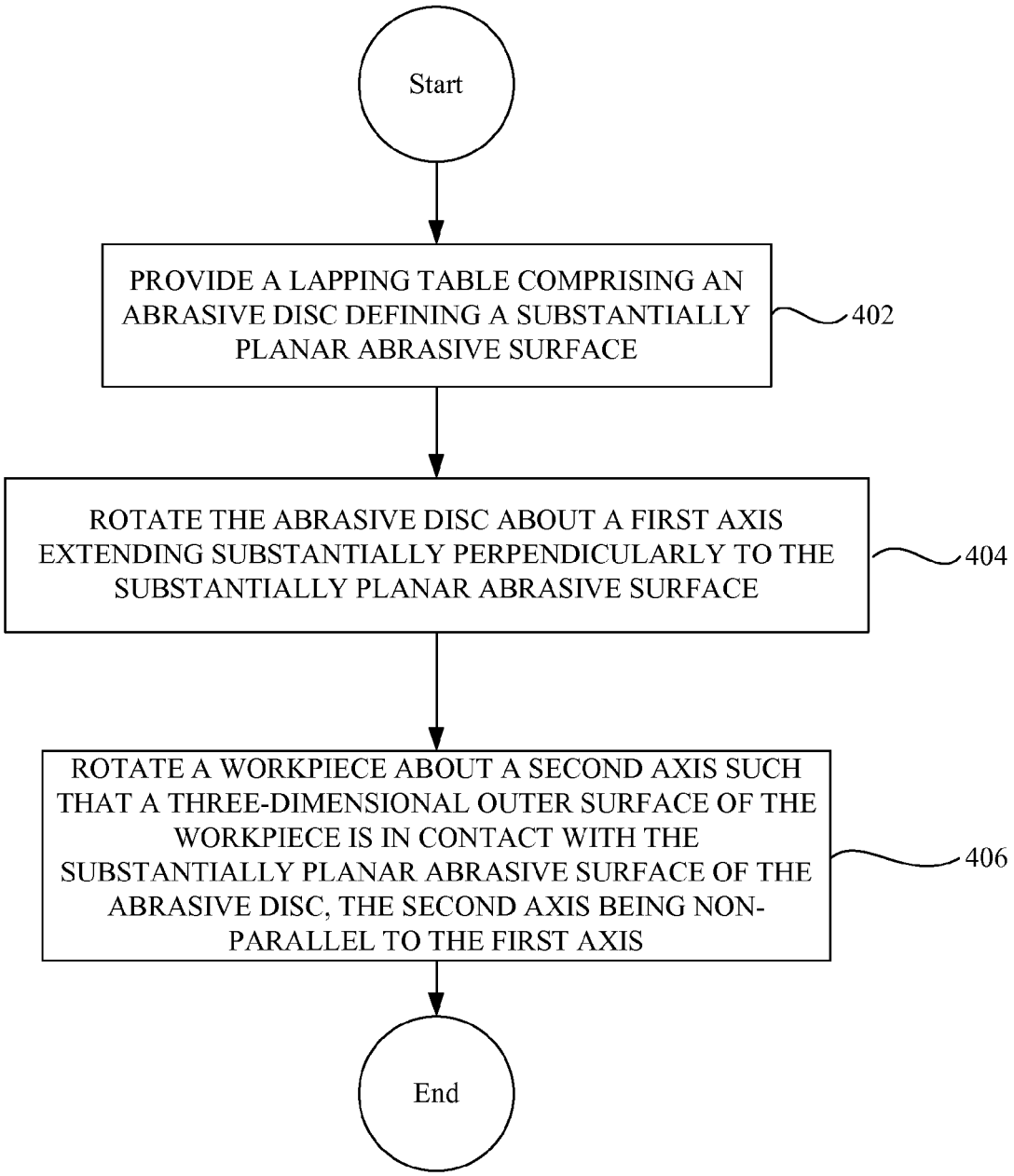
FIG. 7 schematically illustrates a method for performing a lapping operation according to an example embodiment of the present disclosure.

FIG. 7 illustrates a block diagram of a method for performing a lapping operation. As illustrated, the method may include providing a lapping table comprising an abrasive disc defining a substantially planar abrasive surface at operation 402. Further, the method may include rotating the abrasive disc about a first axis extending substantially perpendicularly to the substantially planar abrasive surface at operation 404. Additionally, the method may include rotating a workpiece about a second axis such that a three-dimensional outer surface of the workpiece is in contact with the substantially planar abrasive surface of the abrasive disc, the second axis being non-parallel to the first axis at operation 406.

In some embodiments the workpiece may comprise a cylindrical workpiece and the second axis may extend between first and second end surfaces of the cylindrical workpiece. Further, rotating the workpiece about the second axis at operation 406 may comprise engaging the end surfaces of the cylindrical workpiece. The method may additionally include rotating the workpiece about a third axis, the third axis extending substantially parallel to the first axis. The third axis may be offset by a non-zero distance from the first axis. Rotating the abrasive disc about the first axis, rotating the workpiece about the second axis, and rotating the workpiece about the third axis may be conducted concurrently. The method may additionally include pressing the workpiece against the substantially planar abrasive surface of the abrasive disc.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

Figure 8:
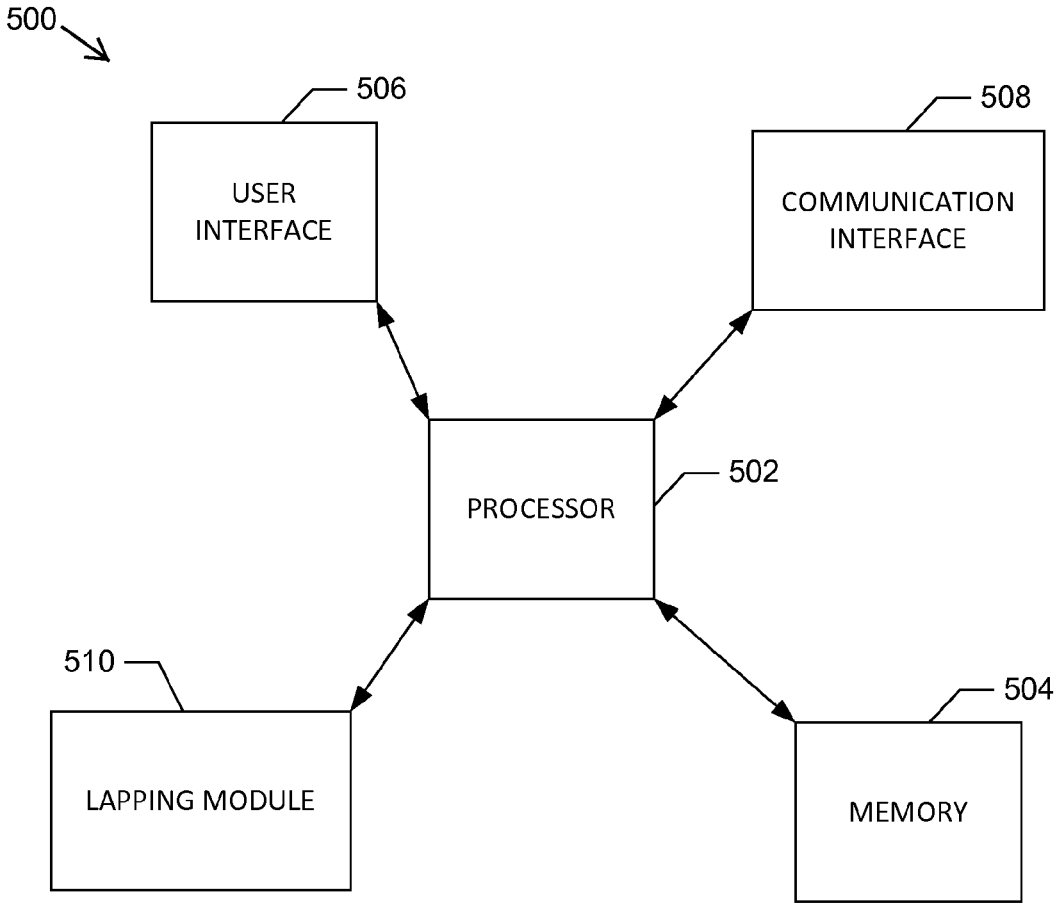
FIG. 8 schematically illustrates a block diagram of an electronic device according to an example embodiment of the present disclosure.

In this regard, FIG. 8 is a block diagram of an electronic device 500 suitable for use with the described embodiments. In one example embodiment the electronic device 500 may be embodied in or as a controller configured for controlling lapping operations as disclosed herein. In this regard, the electronic device 500 may be configured to control or execute the above-described lapping operations performed by the above-described lapping tables 100A, 100B, 200A, 200B, 300. In this regard, the electronic device 500 may be embodied in or as the above-described controller.

The electronic device 500 illustrates circuitry of a representative computing device. The electronic device 500 may include a processor 502 that may be microprocessor or controller for controlling the overall operation of the electronic device 500. In one embodiment the processor 502 may be particularly configured to perform the functions described herein relating to lapping operations. The electronic device 500 may also include a memory device 504. The memory device 504 may include non-transitory and tangible memory that may be, for example, volatile and/or non-volatile memory. The memory device 504 may be configured to store information, data, files, applications, instructions or the like. For example, the memory device 504 could be configured to buffer input data for processing by the processor 502. Additionally or alternatively, the memory device 504 may be configured to store instructions for execution by the processor 502.

The electronic device 500 may also include a user interface 506 that allows a user of the electronic device 500 to interact with the electronic device. For example, the user interface 506 can take a variety of forms, such as a button, keypad, dial, touch screen, audio input interface, visual/image capture input interface, input in the form of sensor data, etc. Still further, the user interface 506 may be configured to output information to the user through a display, speaker, or other output device. A communication interface 508 may provide for transmitting and receiving data through, for example, a wired or wireless network such as a local area network (LAN), a metropolitan area network (MAN), and/or a wide area network (WAN), for example, the Internet.

The electronic device 500 may also include a lapping module 510. The processor 502 may be embodied as, include or otherwise control the finishing module 510. The lapping module 510 may be configured for controlling or executing the lapping operations and associated operations as discussed herein.

In this regard, for example, in one embodiment a computer program product comprising at least one computer-readable storage medium having computer-executable program code portions stored therein is provided. The computer-executable program code portions, which may be stored in the memory device 504, may include program code instructions for performing the lapping operations and associated operations disclosed herein.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for performing a lapping operation, the method comprising:

providing a lapping table comprising an abrasive disc defining a substantially planar abrasive surface;

during a first rotation, rotating the abrasive disc about a first axis, wherein the first axis extends substantially perpendicular to the substantially planar abrasive surface;

during a second rotation, rotating a workpiece about a second axis, the second axis being non-parallel to the first axis; and during a third rotation, rotating the workpiece about a third axis offset from and substantially parallel to the first axis, such that a three-dimensional outer surface of the workpiece is in contact with and lapped by the substantially planar abrasive surface of the rotating abrasive disc, wherein the first, second and third rotations are driven independent of each other.

2. The method of claim 1, wherein the workpiece is a cylindrical workpiece and the second axis extends between a first and second end surface of the cylindrical workpiece.

3. The method of claim 2, wherein rotating the cylindrical workpiece about the second axis comprises engaging the first and second end surfaces of the cylindrical workpiece.

4. The method of claim 3, wherein the pressure applicator includes an actuator that is configured to apply a variable amount of pressure between the cylindrical workpiece and the substantially planar abrasive surface of the abrasive disc.

5. The method of claim 3, wherein a controller is in communication with the pressure applicator to adjust an amount of pressure that is applied to the cylindrical workpiece.

6. The method of claim 2, wherein the lapping table further comprises a pressure applicator, and the pressure applicator engages the first and second end surfaces of the cylindrical workpiece.

7. The method of claim 1, wherein the first rotation, the second rotation, and the third rotation are concurrently driven.

8. The method of claim 1, further comprising pressing the workpiece against the substantially planar abrasive surface of the abrasive disc.

9. The method of claim 1, wherein the lapping table further comprises at least one conditioning ring that is coupled to the workpiece such that the at least one conditioning ring presses the workpiece against the substantially planar abrasive surface of the abrasive disc during the lapping operation.

10. The method of claim 9, wherein the lapping table further comprises at least one support member that is coupled to the at least one conditioning ring.

11. The method of claim 10, wherein the at least one support member comprises an inner engagement mechanism having a roller that is configured to rotate the at least one conditioning ring.

12. The method of claim 1, wherein the first, second and third rotations are driven independent of each other by a controller.

13. The method of claim 12, wherein the controller is configured to control at least one finishing parameter during the lapping operation to produce a pre-determined surface finish on the workpiece.

14. The method of claim 13, wherein the at least one finishing parameter comprises rotational speed, direction, or pressure.

15. The method of claim 1, wherein a second rotational mechanism causes the second rotation and a third rotational mechanism causes the third rotation.

16. The method of claim 1, wherein the third axis is offset by a non-zero distance from the first axis.

17. The method of claim 1, wherein the method is configured to be executed by a non- transitory computer readable medium of a computing device.

18. The method of claim 1, wherein the abrasive disc is coupled to a first rotational mechanism.

19. The method of claim 1, wherein the rotation of the workpiece along the third axis is in a direction that is opposite the first axis.

20. The method of claim 1, wherein the workpiece is characterized as having a substantially even surface finish subsequent to the lapping operation.

* * * * *